US005709228A

United States Patent [19]

Cohen et al.

[11] Patent Number: 5,709,228

[45] Date of Patent: Jan. 20, 1998

[54] CIGARETTE WITH DECREASED SIDESTREAM SMOKE

[75] Inventors: Norman Cohen, Scarborough; Larry Bowen, Orangeville, both of Canada

[73] Assignee: Rothmans, Benson & Hedges, Inc., Don Mills, Canada

[21] Appl. No.: 472,277

[22] Filed: Jun. 7, 1995

Related U.S. Application Data

[63] Continuation-in-part of Ser. No. 348,855, Nov. 28, 1994, which is a continuation of Ser. No. 773,931, Nov. 5, 1991, abandoned.

[30] Foreign Application Priority Data

| | | | |
|---|---|---|---|
| Jun. 2, 1989 | [GB] | United Kingdom | 8912688 |
| Jun. 21, 1989 | [GB] | United Kingdom | 8914267 |
| Jul. 26, 1989 | [GB] | United Kingdom | 8917089 |

[51] Int. Cl.[6] ..... A24D 1/02

[52] U.S. Cl. ..... 131/365; 131/335; 131/336; 131/364

[58] Field of Search ..... 131/360, 362, 131/365, 373, 374

[56] References Cited

U.S. PATENT DOCUMENTS

| | | | |
|---|---|---|---|
| 3,395,714 | 8/1968 | Kahane | 131/15 |
| 3,633,589 | 1/1972 | Kahane | 131/15 |
| 3,744,496 | 7/1973 | McCarty et al. | 131/8 |
| 3,805,802 | 4/1974 | Hedge et al. | 131/365 |
| 4,231,377 | 11/1980 | Cline et al. | 131/9 |
| 4,244,381 | 1/1981 | Lendway | 131/365 |
| 4,505,282 | 3/1985 | Cogbill et al. | 131/334 |
| 4,561,454 | 12/1985 | Guess | 131/365 |
| 4,585,016 | 4/1986 | Grollimund | 131/361 |
| 4,624,268 | 11/1986 | Baker et al. | 131/332 |
| 4,887,618 | 12/1989 | Bernasek | 131/365 |
| 4,984,589 | 1/1991 | Riedesser | 131/365 |
| 5,105,838 | 4/1992 | White et al. | 131/365 |

FOREIGN PATENT DOCUMENTS

| | | | |
|---|---|---|---|
| 0419733 | 4/1989 | European Pat. Off. | 131/365 |
| 1487068 | 7/1981 | France | 131/365 |
| 2366806 | 10/1991 | France | 131/365 |
| 2069310 | 5/1975 | United Kingdom | 131/365 |
| 1162509 | 6/1976 | United Kingdom | 131/365 |

*Primary Examiner*—Vincent Millin
*Assistant Examiner*—Charles W. Anderson
*Attorney, Agent, or Firm*—Sim & McBurney

[57] ABSTRACT

Significant decreases in sidestream smoke production, approximately 30 to 70%, are obtained when compared to a tobacco filler rod wrapped in a conventional cigarette paper by double-wrapping the filler rod, first with a relatively non-porous paper having a Coresta porosity of about 1 to about 10% and then with a conventional cigarette paper.

6 Claims, 1 Drawing Sheet

CIGARETTE WITH DECREASED SIDESTREAM SMOKE

REFERENCE TO RELATED APPLICATION

This application is a continuation-in-part of U.S. patent application Ser. No. 08/348,855, filed Nov. 28, 1994, which itself is a continuation of U.S. patent application Ser. No. 07/773,931 filed Nov. 5, 1991, abandoned.

FIELD OF INVENTION

The present invention relates to a novel cigarette structure which enables a decreased sidestream smoke to be achieved.

BACKGROUND TO THE INVENTION

Cigarettes conventionally comprise a paper tube or wrapper housing a tobacco filler rod and a filter for removing smoke constituents. One of the common problems associated with cigarettes is the amount of sidestream smoke that is formed on static burning, for example, when the cigarette is idling and not being drawn upon by the smoker or is simply resting in an ashtray while burning. Visible sidestream smoke that is formed during static burning is comprised mainly of particulate matter and the smoke often is irritating and objectionable to non-smokers in the vicinity of the idling cigarette.

There have been a number of prior suggestions to provide cigarettes with two or more wrappers, including the following U.S. patents:

U.S. Pat. No. 3,633,589 Kahane

U.S. Pat. No. 3,395,714 Kahane

U.S. Pat. No. 3,744,496 McCarty et al

U.S. Pat. No. 4,231,377 Cline et al

U.S. Pat. No. 4,505,282 Cogbill et al

U.S. Pat. No. 4,585,016 Grollimund

U.S. Pat. No. 4,624,268 Baker et al

In one such patent, U.S. Pat. No. 3,633,589 employs an outer porous conventional cigarette paper and an inner sheet which is practically impervious to the passage of air therethrough. Such materials tend to result in a cigarette which is self-extinguishing.

U.S. Pat. No. 4,984,589 employs a laminate of two layers of material to provide a wrapper for the cigarette. The layers are laminated in a paper-making machine and the resulting wrapper is intended to be used in self-extinguishing cigarettes.

SUMMARY OF INVENTION

In accordance with the present invention, there is provided a novel cigarette structure which results in a decreased sidestream emission. In the invention, the tobacco rod is wrapped with two different paper wrappers which are superimposed one on the other but are not adhered together.

Accordingly, in one aspect of the invention, there is provided a cigarette, comprising a tobacco filler rod wrapped in two different paper wrappers comprising an inner wrapping and an outer wrapping, wherein:

(i) the inner wrapping is formed of a paper having a Coresta porosity of about 1 to about 10 units and having a filler content of about 1 to about 8 wt. %, and (ii) the outer wrapping is formed of a cigarette paper having a weight of about 35 to about 65 g/sq.m. and a filler content of about 18 to about 40 wt. %, whereby a cigarette is provided having a decreased tendency to produce sidestream smoke when compared to said tobacco filler rod wrapped only in said outer wrapping.

In accordance with another aspect of the invention, there is provided a method of assembling a cigarette, which comprises:

simultaneously applying two different paper wrappers comprising an inner wrapping and a separate outer wrapping to a tobacco filler rod to form a wrapped filler rod, and forming individual cigarettes from said wrapped filler rod, wherein:

the inner wrapping is formed of paper having a Coresta porosity of about 1 to about 10 units and having a filler content of about 1 to about 8 wt. %, and the outer wrapper is formed of a cigarette paper having a weight of about 35 to about 65 g/sq.m and a filler content of about 18 to about 40 wt. %, whereby a cigarette is provided having a decreased tendency to produce sidestream smoke when compared to said tobacco filler rod wrapped only in said outer wrapping.

By employing an inner sheet having a limited porosity, in accordance with the invention, an improved cigarette is achieved, since a significant decrease in sidestream smoke production is achieved without tending to self-extinguish.

It will be apparent from the discussion below of the characteristics of the inner wrapper employed herein that the wrapper material differs from that described in the prior art. The characteristics defined herein are required for the provision of the cigarette with low sidestream smoke.

The present invention employs two distinct wrappers on the cigarette, an inner wrapper having defined characteristics and an outer wrapper having defined characteristics. The provision of two separate and distinct wrapping elements, as opposed to a single wrapper laminate in the case of Riedesser, inevitably results in an air gap between the overlying unbonded layers.

Air movement to the burning core of the cigarette is critical if the cigarette is to remain lit when not being puffed on. Although a low sidestream smoke cigarette is provided herein and, if wrapped only by the inner wrapper, the cigarette would self-extinguish, the presence of the air gap between the inner and outer layers ensures that the cigarette remains alight when not being puffed on. This situation can be contrasted with the Riedesser reference, where the single laminate lacks the air gap and, indeed, the cigarette is designed to self-extinguish when not smoked on.

DESCRIPTION OF INVENTION, PREFERRED EMBODIMENT AND BEST MODE

Figure 1:
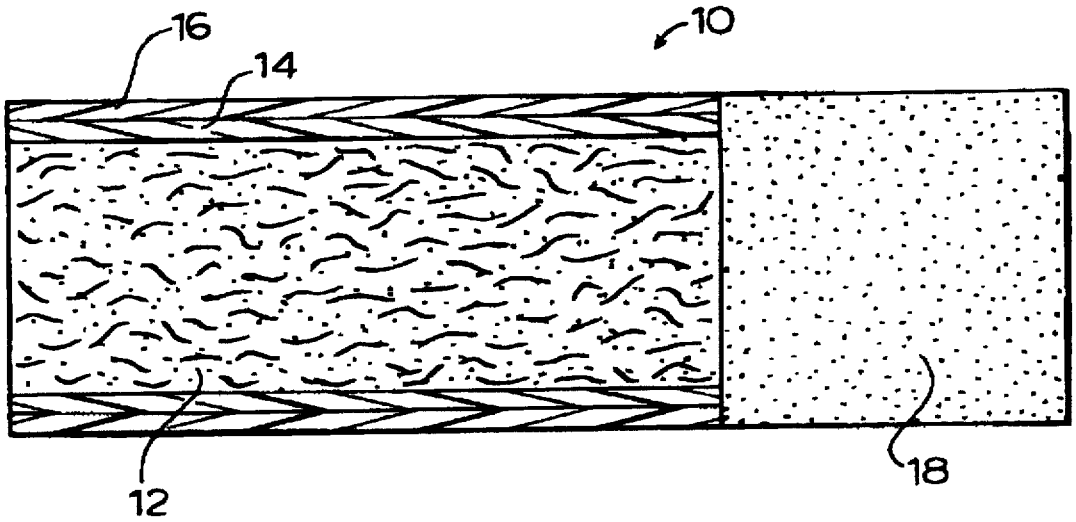
FIG. 1 is a sectional view of a cigarette provided in accordance with one embodiment of the invention.

Referring to the FIGURE, a cigarette 10 in accordance with one embodiment of the invention, comprises a tobacco filler rod 12 enclosed by an inner 14 and outer 16 wrapper as described more particularly below, the cigarette being provided with a filter 18 of conventional construction.

The inner wrapper in the present invention is formed of a particular type of paper which is relatively non-porous but has some porosity and contains very little filler. This paper is quite slow burning and tends to produce a significant decrease in sidestream smoke. However, on its own, this wrapper tends to produce an unsightly black ash and has a tendency to extinguish the cigarette, both of which are undesirable.

It has surprisingly been found that, if the special paper wrapper is wrapped again with an outer wrapper of conventional cigarette paper, then the significant decrease in sidestream smoke is retained, while the black ash color is not visible and there is a decreased tendency for the cigarette to go out. In addition, the cigarette exhibits a decreased tendency to ignite combustible materials.

The present invention, therefore, employs a double wrapping of the tobacco rod in the finished cigarette, namely an inner wrapping of a special paper and an outer wrapping of a conventional cigarette paper.

The special paper possesses certain properties as noted above. The paper is relatively non-porous but has some porosity, possessing a Coresta porosity of about 1 to about 10 units, preferably about 1 to about 5 units (Coresta porosity is described in the international standard I.S.O. 2965). The low but positive porosity is critical to obtaining a significant decrease in sidestream smoke, in that papers with a porosity of higher than about 5 Coresta units or lower than about 1 Coresta unit are not nearly as effective. In addition, below 2, the cigarette becomes self-extinguishing.

The special paper also has a low filler content, generally about 1 to about 8 wt. %, preferably less than about 5%. The paper may have a paper weight which is typically about 18 g/sq.m.

In addition to these properties, the inner wrapper may have other characteristics. One component which may be present are salts of organic chemicals, such as citric acid or its salts, to modify the burning rate of the inner wrapper. Such materials, when present, may comprise about 0.1 to about 2 wt. %.

The inner wrapper may be provided with perforations to permit the passage of gases through them, with such perforations being made mechanically, electrostatically or by laser beam.

The decrease in sidestream smoke which is observed is a significant decrease, generally approximately 30% to 70%, over the sidestream produced by smoking a conventionally-wrapped cigarette of the same tobacco blend.

The outer wrapper is provided by conventional cigarette paper. Such conventional paper preferably has a weight of about 35 to about 65 g/sq.m. and a filler content of about 18 to about 40 wt. %. Burn rate improvement additives, such as citric acid or its salts, also may be present in an amount of about 0.2 to about 4 wt. %.

The cigarettes according to the present invention are produced in any convenient manner, generally on a conventional cigarette making machine, with the two wrappers applied to the tobacco filler rod, sequentially or preferably simultaneously.

SUMMARY OF THE DISCLOSURE

As described above, the present invention provides a novel cigarette structure having a decreased sidestream smoke emission by employing a double-wrapping of the tobacco rod, with an inner wrapper of low porosity paper. Cigarettes are staple items of commerce and, accordingly, the present invention has industrial application. Modifications are possible within the scope of this invention.

We claim:

1. A cigarette, comprising a tobacco filler rod wrapped in two different paper wrappers comprising an inner wrapping and an outer wrapping which overlie one another in non-adhered relationship, wherein:

(i) the inner wrapping is formed of a paper having a Coresta porosity of about 1 to about 10 units and having a filler content of about 1 to about 8 wt. %, and (ii) the outer wrapping is formed of a cigarette paper having a weight of about 35 to about 65 g/sq.m. and a filler content of about 18 to about 40 wt. %, whereby a cigarette is provided having a decreased tendency to produce sidestream smoke when compared to said tobacco filler rod wrapped only in said outer wrapping.

2. The cigarette of claim 1 wherein said inner wrapping has a Coresta porosity of about 1 to about 5 units.

3. The cigarette of claim 2 wherein said inner wrapping has a filler content of about 1 to about 8 wt. %.

4. The cigarette of claim 1, wherein said outer wrapping additionally contains at least one burn-rate modifying chemical in an amount of about 0.2 to about 4 wt. %.

5. The cigarette of claim 1, 2, 3 or 4 wherein said inner wrapping additionally contains about 0.1 to about 2 wt. % of at least one burn rate modifying chemical.

6. A method of assembling a cigarette, which comprises:

simultaneously applying two different paper wrappers comprising an inner wrapping and a separate outer wrapping to a tobacco filler rod to form a wrapped filler rod, and forming individual cigarettes from said wrapped filler rod, wherein:

the inner wrapping is formed of paper having a Coresta porosity of about 1 to about 10 units and having a filler content of about 1 to about 8 wt. %, and the outer wrapper is formed of a cigarette paper having a weight of about 35 to about 65 g/sq.m and a filler content of about 18 to about 40 wt. %, whereby a cigarette is provided having a decreased tendency to produce sidestream smoke when compared to said tobacco filler rod wrapped only in said outer wrapping.

* * * * *